US008015867B2

(12) United States Patent
Kerr et al.

(10) Patent No.: US 8,015,867 B2
(45) Date of Patent: Sep. 13, 2011

(54) ELONGATED PROBE

(75) Inventors: Bradley Kerr, Richmond, TX (US); Elizabeth B. Dussan, V., Ridgefield, CT (US); Nathan Church, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 539 days.

(21) Appl. No.: 12/244,872

(22) Filed: Oct. 3, 2008

(65) Prior Publication Data

US 2010/0083748 A1 Apr. 8, 2010

(51) Int. Cl.
*E21B 49/10* (2006.01)

(52) U.S. Cl. ..... 73/152.26; 166/100

(58) Field of Classification Search ..... 73/152.26, 73/152.36; 166/100, 387

See application file for complete search history.

(56) References Cited

U.S. PATENT DOCUMENTS

| | | | | |
|---|---|---|---|---|
| 2,581,070 | A * | 1/1952 | Blood | 166/100 |
| 4,951,749 | A * | 8/1990 | Carroll | 166/264 |
| 5,265,015 | A | 11/1993 | Auzerais et al. | |
| 5,279,153 | A | 1/1994 | Dussan et al. | |
| 6,230,557 | B1 * | 5/2001 | Ciglenec et al. | 73/152.01 |
| 6,729,399 | B2 * | 5/2004 | Follini et al. | 166/264 |
| 6,986,282 | B2 | 1/2006 | Ciglenec et al. | |
| 7,114,562 | B2 | 10/2006 | Fisseler et al. | |
| 7,121,338 | B2 * | 10/2006 | van Zuilekom et al. | 166/264 |
| 7,128,144 | B2 | 10/2006 | Fox et al. | |
| 7,416,023 | B2 * | 8/2008 | Krueger et al. | 166/250.01 |
| 7,458,419 | B2 * | 12/2008 | Nold et al. | 166/100 |
| 7,584,655 | B2 * | 9/2009 | van Zuilekom et al. | 73/152.26 |
| 7,584,786 | B2 * | 9/2009 | Nold et al. | 166/100 |
| 7,650,937 | B2 * | 1/2010 | Fox et al. | 166/264 |
| 7,654,321 | B2 * | 2/2010 | Zazovsky et al. | 166/264 |
| 7,793,713 | B2 * | 9/2010 | Nold et al. | 166/100 |
| 7,841,406 | B2 * | 11/2010 | Zazovsky et al. | 166/264 |
| 2007/0039731 | A1 * | 2/2007 | Fox et al. | 166/264 |
| 2007/0151724 | A1 * | 7/2007 | Ohmer et al. | 166/187 |
| 2007/0151727 | A1 * | 7/2007 | Tao et al. | 166/250.1 |
| 2007/0215348 | A1 | 9/2007 | Corre et al. | |
| 2008/0142214 | A1 * | 6/2008 | Keller | 166/250.01 |
| 2008/0156487 | A1 * | 7/2008 | Zazovsky et al. | 166/264 |
| 2010/0132940 | A1 * | 6/2010 | Proett et al. | 166/250.17 |

* cited by examiner

*Primary Examiner* — John Fitzgerald

(57) ABSTRACT

A formation testing probe assembly comprising an elongated packer having a surface configured to be urged by the probe assembly towards a wall of a wellbore extending through the formation. The formation testing probe assembly further comprises a plate embedded in the elongated packer and including a central structural portion extending along a centerline of a substantial length of the plate, wherein the central structural portion is substantially thicker than remaining portions of the plate.

37 Claims, 10 Drawing Sheets

ELONGATED PROBE

BACKGROUND

FIG. 1 is a cross-section of a known formation testing/sampling probe assembly 100 viewed in a plane containing the wellbore axis. The assembly 100 includes a packer 101 configured to be pressed against a formation of interest via hydraulically actuated pistons schematically shown as 103 and 104. Deformation of the packer 101 around an extendable probe barrel 102 and against the formation creates a seal that isolates the formation fluids and pressure from the wellbore environment. The probe barrel 102 extends forward, due to high pressure hydraulic oil entering chamber 105 at the same time pistons 103 and 104 are actuated to apply an extension force. The area of investigation by the probe assembly 100 is limited to the area that is in direct contact with the extendable probe barrel 102, usually called the orifice. This area is limited by the diameter of the probe barrel 102, which is about the same dimension as the diameter of the hole 106 in the packer 101 through which the probe barrel 102 passes.

Other prior art has sought to improve upon the design of the probe assembly 100 by increasing the diameter of the probe barrel. Nonetheless, the area of investigation is still limited to the largest diameter of the probe barrel, which is currently between two and three inches. This could be problematic for formations with thin laminations where the formation may have a small (e.g., ~0.5 inches thick) production zone sandwiched between thicker zones of impermeable formation. With prior art designs, finding a non-producing zone is much more likely due to the small lateral extent (the probe barrel diameter) of the area of investigation.

One attempt at addressing this thin lamination problem involved elongating the packer, such as with the known probe assembly 200 shown in FIG. 2. The elongated packer 201 of the probe assembly 200 is pressed against the formation by backing plate 202 to create a seal. However, in this case, an annular shaped metal spacer 207*a* fills the upper hydraulic chamber 207, preventing the probe barrel 208 from extending forward. Since the packer 201 and backing plate 202 are elongated along the central axis of the wellbore, a number of formation laminations could be investigated. The axial length of investigation using the probe assembly 200 could approach several inches, including one known embodiment in which the length was about seven inches.

However, problems with the probe assembly 200 have been discovered. For example, the packer 201 is not as constrained at its inner boundary as it is near the raised rim 203 of the backing plate 202 that defines the orifice of the probe. It has been found that the packer material 201 migrates into the probe's orifice during formation testing operations. The large difference in pressures between the wellbore, pushing on surfaces 204, and the probe orifice, pushing on the packer surface near the raised rim 203, forces the packer material to move into the orifice. This movement decreases the ability of the packer 201 to seal against the formation and prevents the tool's pressure gauges from equilibrating to that of the pressure of the formation fluid. As the elastomeric material of the packer 201 is sucked into the probe orifice, the hydraulic pressure declines in the pistons (schematically shown in FIG. 2 as 205 and 206) applying the extension force (a consequence of the tool design). This, in turn, results in a decline in the force pushing the packer against the formation, further exacerbating the situation, and resulting in both packer damage and loss of seal. This design has lead to a high number of lost seals.

Another problem that exists with the design shown in FIG. 2 is that the upper surface of the raised rim 203 of the backing plate 202 is located well below the surface of the elastomer 201 that seals against the wellbore wall. As a consequence, elastomer must be compressed before the raised rim 203 makes contact with the wellbore wall. This is of considerable disadvantage because it requires performing large volume pretests. On the other hand, if this difference in heights between the surface of the raised rim 203 and the sealing surface of the elastomer 201 didn't exist, then it would not be possible for the elastomer 201 to form a seal against the wellbore wall, because the metal spacer 207*a* makes the probe barrel 208 and the backing plate 202 move in unison.

SUMMARY OF THE DISCLOSURE

The present disclosure introduces the concept of embedding a reinforcement plate into the elastomeric structure of the packer. The embedded plate and the elastomeric structure of the packer are held against the formation by the extended probe. The embedded plate may further provide a surface against which a hydraulically actuated probe barrel can press the embedded plate against the formation. This ensures the tool is firmly locked in place and maintains near constant hydraulic system sealed volume as measurements described in the prior art are completed.

The embedded plate may also or alternatively provide a support structure that constrains the inward movement of the elastomer material of the packer. The proposed design may lead to reduced damage during use, increased differential pressure capability, and/or reduced lost seal incidents.

The present disclosure provides for the implementation of one or more of the following aspects, among others within the scope of the present disclosure: (1) a plate embedded in the sealing surface of the packer whose raised rim defining the probe orifice is at the same level as the packer surface; (2) a smaller diameter hole in the plate in front of the probe barrel, specifically smaller than the outer diameter of the probe barrel, so that the probe barrel pushes against the plate when the probe barrel is extended forward; (3) a hydraulically driven probe barrel that extends forward when the probe assembly is pushed against the wellbore wall; and (4) a supporting metal ridge in the center of the plate straddling the hole through which fluid enters the flow line of the tool and by which the formation pressure is measured.

One embodiment within the scope of the present disclosure introduces a formation testing probe assembly comprising an elongated packer having a surface configured to be urged by the probe assembly towards a wall of a wellbore extending through the formation. The formation testing probe assembly further comprises a plate embedded in the elongated packer and including a central structural portion extending along a centerline of a substantial length of the plate, wherein the central structural portion is substantially thicker than remaining portions of the plate.

The central structural portion may extend in a direction substantially away from the packer surface, and may have a substantially tapered profile, perhaps at an angle of about 150°. Such a central structural portion may extend the entire length of the plate.

The central structural portion may alternatively extend in a direction substantially towards the packer surface, and may have a substantially rectangular profile. Such a central structural portion may extend along approximately 25% of the entire length of the plate.

Alternatively, the central structural portion includes: a first portion extending in a first direction substantially away from the packer surface; and a second portion extending in a second direction substantially towards the packer surface. The first portion of the central structural portion may have a substantially tapered profile, and the second portion of the central structural portion may have a substantially rectangular profile. The first portion of the central structural portion may extend the entire length of the plate, and the second portion of the central structural portion may not extend the entire length of the plate.

The embedded plate may further comprise a raised rim proximate a perimeter of the plate, wherein the rim has an outer surface that is substantially flush with the packer surface.

The formation testing probe assembly may further comprise an extendable barrel configured to be translated within the formation testing probe assembly towards the embedded plate. The embedded plate may include a first inlet extending through the central support structure, and the elongated packer may include a second inlet. The first and second inlets may be substantially coaxial with the extendable barrel, and the first inlet may have an inner diameter that is substantially less than an outer diameter of the extendable barrel.

The elongated packer may substantially comprise an elastomeric material, and may have a substantially cylindrical outer surface. The embedded plate may also include a raised lip extending around a perimeter of the embedded plate, wherein the raised lip terminates at a surface that is substantially flush with the substantially cylindrical outer surface of the elongated packer.

The formation testing probe assembly may be a component of a logging-while-drilling (LWD) tool. The formation testing probe assembly may alternatively be a component of a wireline tool. More generally, the formation testing probe assembly may be a component of a formation tester conveyed by any conveyance means known in the art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
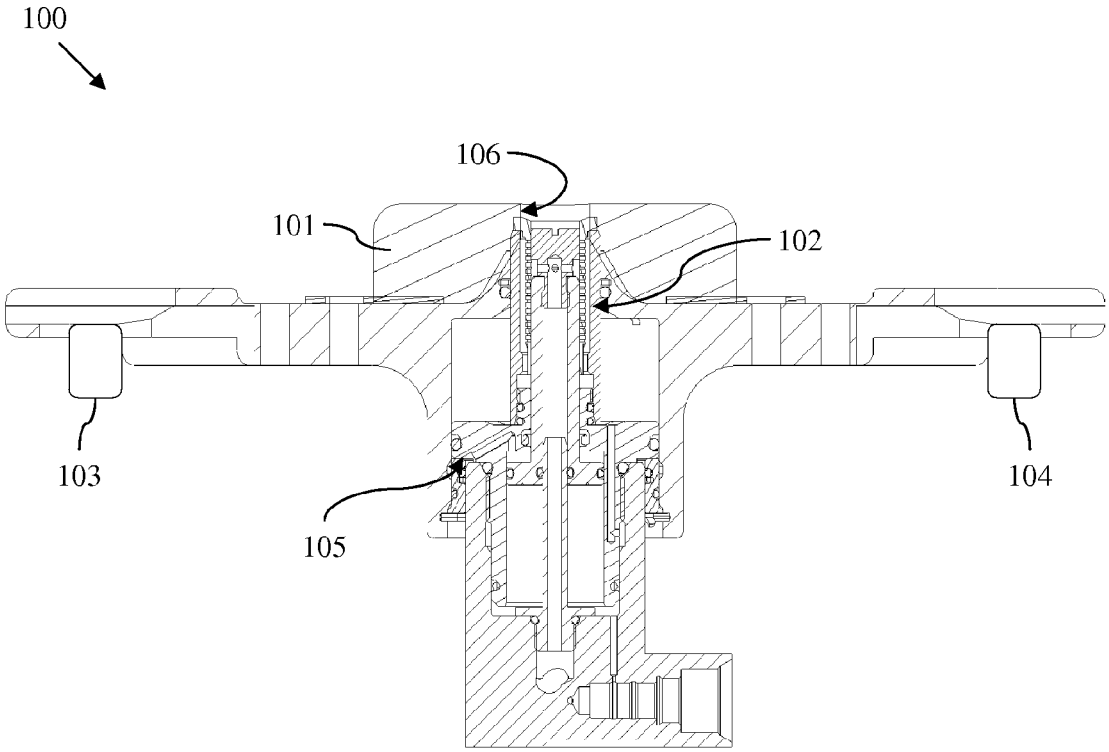
Fig. 1 Prior Art
FIG. 1 is a sectional view of a probe assembly of the prior art.
Figure 2:
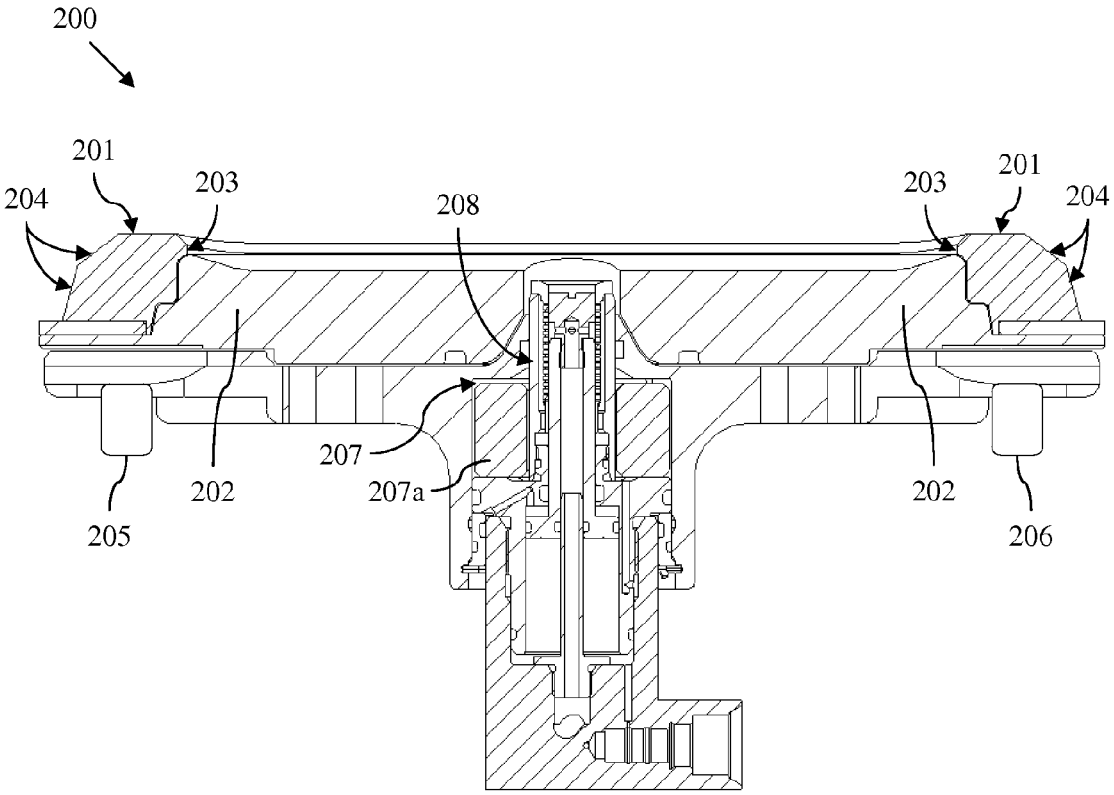
Fig. 2 Prior Art
FIG. 2 is a sectional view of another probe assembly of the prior art.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 3:
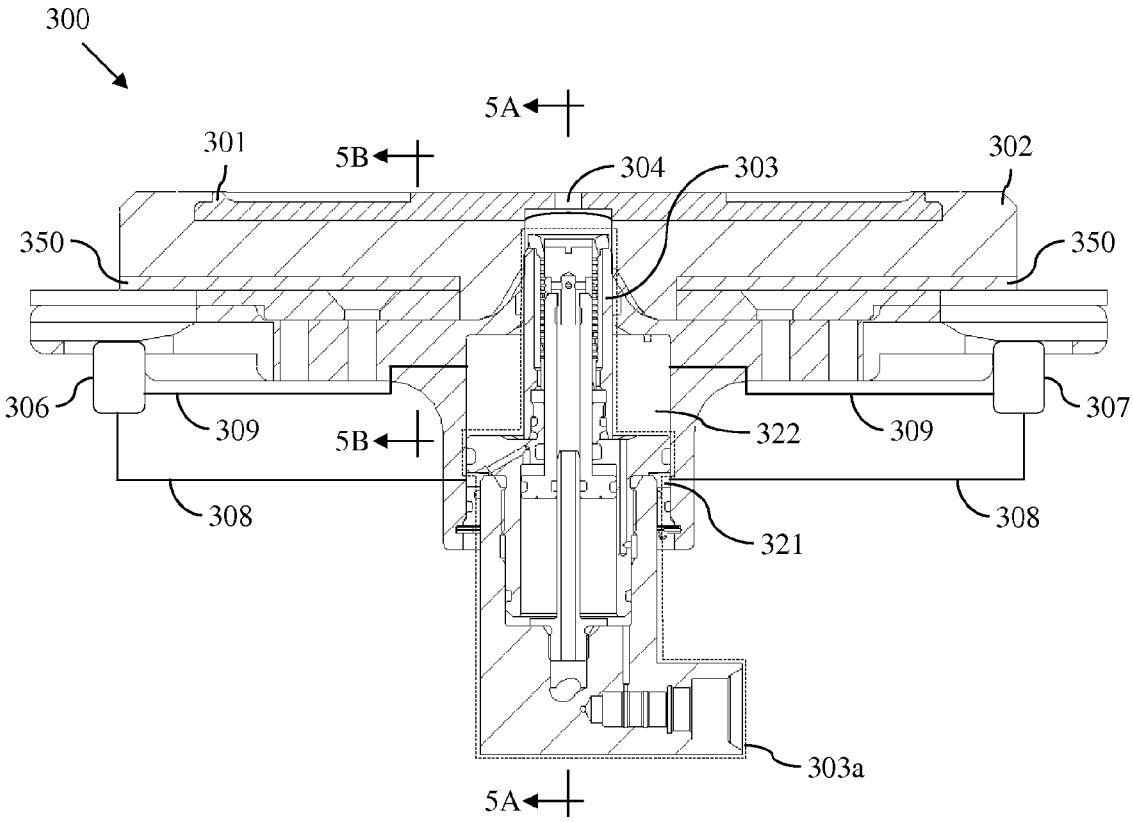
FIG. 3 is a sectional view of a probe assembly according to one or more aspects of the present disclosure.

Referring to FIG. 3, illustrated is a sectional view of at least a portion of an elongated probe assembly 300 according to one or more aspects of the present disclosure. The elongated probe assembly 300 includes an elastomeric packer 302, a plate 301 embedded in the packer 302, and a hydraulically operated probe 303. The plate 301 may substantially comprise steel and/or other metals.

The hydraulic design by which the probe barrel 303 pushes against the embedded plate 301 may vary within the scope of the present disclosure. In an exemplary embodiment, as schematically depicted in FIG. 3, one or more conduits 308 extend from a high pressure hydraulic oil chamber of one or both of the setting pistons 306 and 307 to an annular hydraulic oil chamber 321 that pushes forward the entire subassembly containing the probe barrel (shown by dashed lines 303*a*). Low pressure hydraulic oil in annular chamber 322 is free to flow through another conduit(s) 309 leading to a low pressure hydraulic oil chamber of one or both of the setting pistons 306 and 307. However, other hydraulic circuits interconnecting the probe subassembly 303a and the setting pistons 306 and 307 are also within the scope of the present disclosure.

Upon actuation, the packer 302 deforms and the hydraulically actuated probe barrel 303 presses against the embedded plate 301. A hole 304 in the embedded plate 301 is smaller than the outer diameter of the probe barrel 303. The embedded plate 301 is pressed against the formation by both the elastomer compound of the packer 302 and the probe barrel 303. The perimeter of the embedded plate 301 also provides an inner constraint around which the packer 302 can deform and seal. During operation, the pressure against the embedded plate 301 minimizes the ability of resultant differential forces (created by the large wellbore pressure relative to that in the orifice) to cause movement of the elastomer material of the packer 302 into the orifice. Moreover, in the event that the elastomer material of the packer 302 does migrate, the migration will not change the tool's internal hydraulic pressure since the tool is hydraulically locked in place with no compressible features between the tool's hydraulically actuated components and the formation. That is, the embedded plate 301 physically touches the formation, the probe barrel 303 physically touches the plate 301, and the probe barrel 303 is held in place by a column of hydraulic fluid that is connected to a common supply.

The common supply provides hydraulic flow and pressure to pistons 306 and 307 that actuate (extend) the probe assembly 300, as well as back-up pistons that may be employed to anchor the tool in place. Each of the pistons 306 and 307 is held in place with a hydraulic column connected to the common supply. This arrangement creates a wall-to-wall span that does not include the compressible packer element 302. In addition, the flowline volume, or flowline stiffness, may not experience appreciable change due to compression or relaxation of the packer 302 because the effects of packer migration may now be reduced or eliminated. The constant flowline volume may also result in better pressure readings and tool performance. Implementing this embedded plate concept may allow for application of a much higher differential pressure across the face of the packer. Lab test and field results have shown both a stabilization of hydraulic pressures and significantly better performance in the number of pressure stations achieved, as well as an increase in the differential pressure that the packer is able to withstand before failure.

Figure 4:
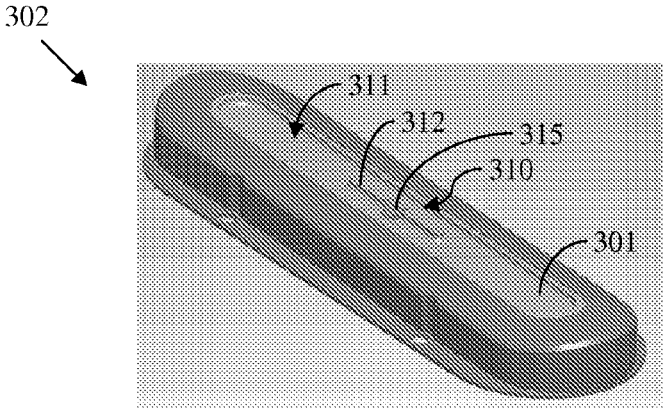
FIG. 4 is a perspective view of a portion of the probe assembly shown in FIG. 3.
Figure 5A:
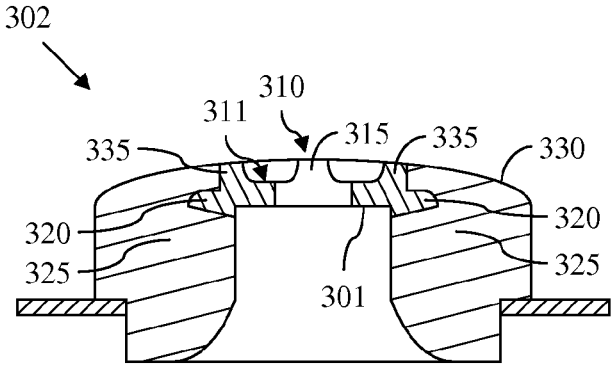
FIGS. 5A and 5B are sectional views of a packer portion of the probe assembly shown in FIG. 3.
Figure 5B:
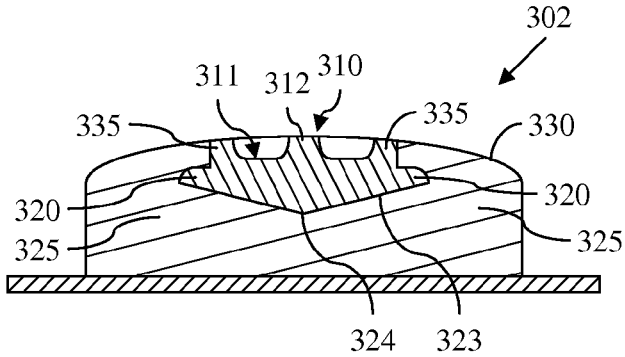

FIG. 4 is a perspective view of the packer 302 shown in FIG. 3. FIGS. 5A and 5B are sectional views of the packer 302 shown in FIG. 3, taken along section lines depicted in FIG. 3. Referring to FIGS. 3-5B, collectively, the packer 302 is shown as including a concave embedded plate 301. The plate 301 includes a support structure 310 near its center. The support structure 310 is configured to allow the plate to withstand higher pressure differentials. Pressure differentials occur when the packer is applied against the wellbore wall and fluid is drawn from the formation into the tool (e.g., by using a reciprocating pump for sampling, or by using a drawdown piston for formation pretest). As fluid is drawn into the tool, the pressure in the recessed volume is lowered below the formation pressure to induce flow in the tool, and also below the wellbore pressure that can be sometimes up to 10,000 psi above the formation pressure in a depleted reservoir. The concave plate 301 is then subjected to the low pressure in the recessed volume on one side, and to essentially the wellbore pressure on the other side, transmitted by the resilient elastomer material of the packer 302.

The support structure 310 is configured to permit fluid flow from the sealed volume defined by the embedded plate 301 as the probe is placed into engagement with the wellbore wall. The support structure 310 may be implemented with a protruding rib 312 that is affixed or internal to an outer surface 311 of the plate 301 that extends to and is usually supported by a wellbore wall when the probe is extended towards the wellbore wall. Without the support structure 310, the embedded plate 301 would tend to deform when exposed to high pressure differentials. Such deformation may be permanent, which may signify a probe failure, or may be elastic. In either case, the deformation of the plate 301 may lead to variations of the recess volume between the embedded plate and the formation wall. The volume variation may render difficult the interpretation of various tests performed with the probe (e.g., example mobility tests). However, lab and field tests have shown that the support structure 310 may solve these issues.

Figure 6A:
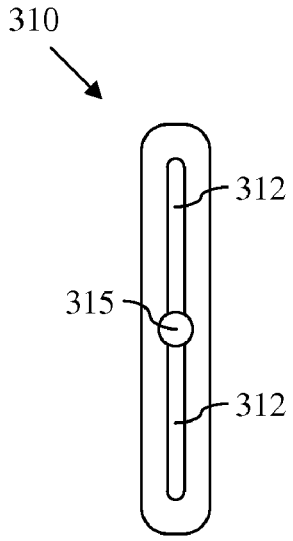
FIGS. 6A-6F are schematic views of a portion of a probe assembly according to one or more aspects of the present disclosure.
Figure 6B:
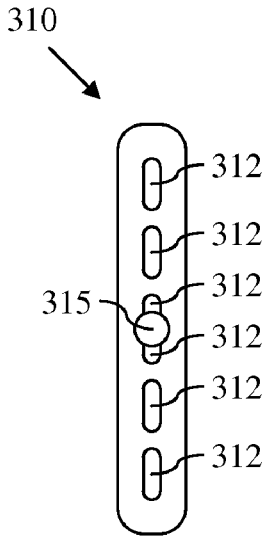
Figure 6C:
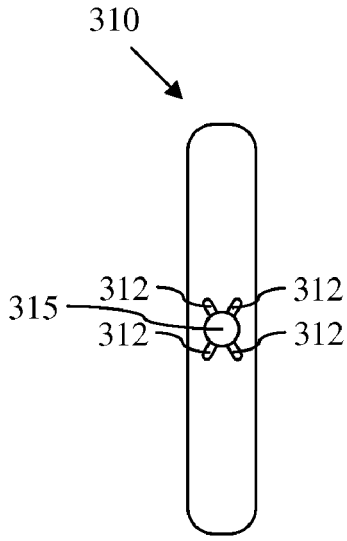
Figure 6D:
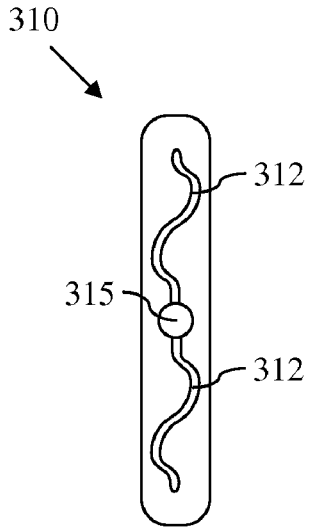
Figure 6E:
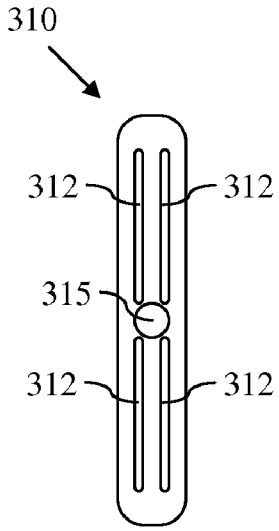
Figure 6F:
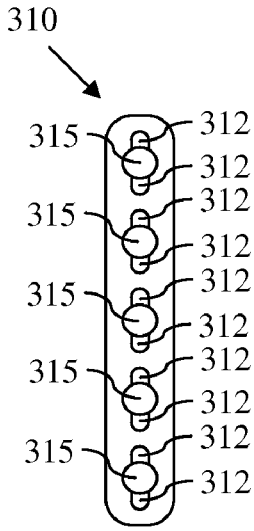

The shape and size of the support structure could have several variations, as demonstrated by FIGS. 6A-6F. Each embodiment includes one or more ribs 312 and an inlet 315. These alternate shapes may be advantageous for facilitating the flow of fluid from the entire sealed area into the probe inlet, and/or providing additional support to the embedded plate. For example, an advantage of the embodiment shown in FIG. 6B may be that it allows for fluid flow through it, in contrast to support structure made of one solid rib. The embodiments of FIGS. 6D and 6E may provide additional supports to the embedded plate. The embodiment of FIG. 6A may provide a support extending over a larger length. The embodiment of FIG. 6C may provide support close to the inlet, which may be the weakest structural point of the embedded plate under differential pressure. FIG. 6F also demonstrates that multiple flow paths/inlets 315 and support structures/ribs 312 could be included in the embedded plate 301.

The support structures/ribs 312 may be made of metal (e.g., the same metal as the plate 301), or any other material having sufficient mechanical strength. For example, the rib 312 may be made of porous material allowing fluid flow therethrough.

Other probe configurations having multiple inlets have been discussed in the prior art, including in U.S. Pat. Nos. 3,396,796, 5,265,015, and 5,279,153, which are incorporated herein by reference. One or more aspects of the present disclosure may also be implemented in such prior art embodiments, including where additional barriers (not shown) between the inlets could be implemented to provide hydraulic seals between the inlets. These barriers may be used, for example, to separate mud filtrate extracted from the formation and virgin formation fluid. However, these prior art probes are not equipped with an embedded plate having a support structure, and it should be appreciated that these probes could also benefit from the improvements described herein.

Returning to FIGS. 3-5B, the embedded plate 301 may include a flange 320 extending into an interior portion 325 of the elastomeric material 330 of the packer 302. The flange 320 may be a perimeter flange, extending around a substantial portion of the perimeter of the embedded plate 301. The embedded plate 301 may also include a raised lip or rim 335 extending therefrom. The rim 335 may be a perimeter rim, extending around a substantial portion of the perimeter of the embedded plate 301. The upper/outer surface of the rim 335 may be substantially flush with the upper/outer surface of the elastomeric material 330 of the packer 302. For example, the upper/outer surfaces of the rim 335 and the elastomeric material 330 of the packer 302 may each be substantially cylindrical and have substantially the same radius. Moreover, this radius may be substantially the same as the inner radius of the wellbore wall. However, other configurations are also within the scope of the present disclosure.

The recess or orifice defined by the rim 335 and the surface 311 may have a depth that is optimized to create as small of a dead volume in the hydraulic circuit as possible. For example, in the illustrated embodiment, the depth of the recess is about ⅛ inch, measured from the top of the centerpoint of the support structure 310. However, other recess depths are also within the scope of the present disclosure. For example, other embodiments may have a recess depth ranging between about 0.10 inch and about 0.25 inch. The recess depth should not be greater than about one-half the thickness of the elastomeric material 330, and in many embodiments is at least an order of magnitude less than the thickness of the elastomeric material 330.

As best shown in FIG. 5B, the interior portion of the embedded plate 301 may also have a tapered lower profile 323 ending at an apex 324. The lower profile 323 may be substituted for, or combined in conjunction with, the rib 312 described above to form the support structure 310. In the illustrated embodiment, the angle A of the tapered profile 323 may range between about 120° and about 170°. For example, the angle A may preferably range between about 135° and about 160°. In the illustrated example, the angle A is about 150°. In other embodiments, the lower profile 323 may have shapes other than as shown in FIG. 5B, such as a rounded and/or multifaceted profile. In any case, the lower profile 323 may be configured to maximize the structural rigidity of the embedded plate 301 in resisting the pressure differential across the plate during operation, while minimizing the extent to which the plate 301 would otherwise impede elastic flexure of the elastomeric material 330.

The support structure 310 of the embedded plate 301, whether comprising one or more ribs 312 and/or the rigidizing lower profile 323, may prove advantageous over prior art solutions. For example, in comparison to the elongated probe shown in FIG. 7H of U.S. Pat. No. 7,128,144, the interior contour of the embedded plate 301 of the present disclosure is substantially different. That is, the embedded plate 301 of the present disclosure may have large radii along the sides and ends of the embedded plate where the vertical and horizontal portions of the embedded plate intersect. In contrast, the embedded plate shown in FIG. 7H of U.S. Pat. No. 7,128,144 includes essentially sharp corners. Additionally the embodiment shown in FIG. 7A of U.S. Pat. No. 7,128,144 indicates that the depth of the plate is substantially unchanged across the entire face of the plate. In contrast, the embedded plate 301 of the present disclosure may be shallower near the long sides and the curved ends than it is at the center as a result of the incorporated large radii. The large radii in conjunction with the thickness of the plate make the elongated probe of the present disclosure capable of withstanding larger pressure differentials relative to the embodiments shown in U.S. Pat. No. 7,128,144.

Moreover, the embodiment shown in FIG. 7F of U.S. Pat. No. 7,128,144 includes a pocket width of 1.75 inches with a significantly thin embedded plate. This large facial area as defined by FIGS. 7F and 7D (1.75 inches by 9.00 inches) combined with the thin embedded plate will not withstand large differential drawdown operations. The present inventors have tested similar versions of such elongated probes, where were deemed failed due to excessive cracking and deformation of the embedded plate as a result of large facial area and/or insufficient radii near perpendicular walls creating stress concentration areas. Thus, at least one or more aspects of the present disclosure represent significant improvement of the embodiments shown in U.S. Pat. No. 7,128,144.

The packer 302 of the present disclosure may be manufactured as three components: the base plate 350, the embedded plate 301, and the elastomer compound 330. For example, the base plate 350 and the embedded plate 301 may comprise stainless steel, Inconel, and/or other metals, and may be manufactured via machining, molding, pressing, and/or other metal-working processes. The support structure 310 may be a separate component that is welded or otherwise affixed to the plate, or may be an integral portion of the embedded plate 301. The base plate 350 and the embedded plate 301 may then be placed in a molding jig, which is then subjected to an elastomer molding process. As a result, the embedded plate 301, and possibly the base plate 350, are embedded within the elastomeric compound 330. The elastomeric compound may be or comprise nitrile butadiene rubber (NBR), hydrogenated nitrile butadiene rubber (HNBR) and/or a perfluoroelastomer, among other materials.

Figure 5C:
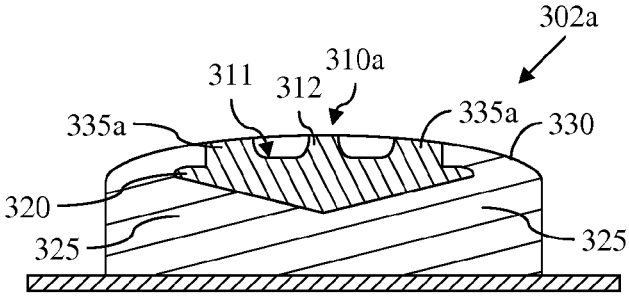
FIG. 5C is a sectional view of another embodiment of the packer portion shown in FIGS. 5A and 5B.

Referring to FIG. 5C, illustrated is a sectional view of another embodiment of the packer 302 shown in FIGS. 5A and 5B, herein designated by reference numeral 302*a*. The packer 302*a* is substantially similar or identical to the packer 302 shown in FIGS. 5A and 5B except as described below. The primary difference is that the rim 335*a* of the embedded plate 301*a* of the packer 302*a* is substantially wider than the rim 335 of the embedded plate 301 of the packer 302. The dimensions of the recess or orifice of each packer 302, 302*a*, however, may be substantially the same. Thus, the widening of the rim is at the expense of removing some of the elastomer material 330. In some embodiments of operation, the packer 302/302*a* may be set against a soft wellbore wall that may be indented by the large force of the rim. However, such indentation by the rim of the embedded plate can adversely affect subsequent pressure measurements, at least partly because it could result in changes to the flow line volume that are dependent on the flow line pressure. Widening the rim, however, may reduce the size of any deformation created by the rim of the embedded plate in the softer wellbore wall. Thus, in the embodiment shown in FIG. 5C, the width of the rim 335*a* is about twice the width of the rim 335 shown in FIGS. 5A and 5B. However, other variations of the width of the embedded plate rim are also within the scope of the present disclosure.

Figure 7:
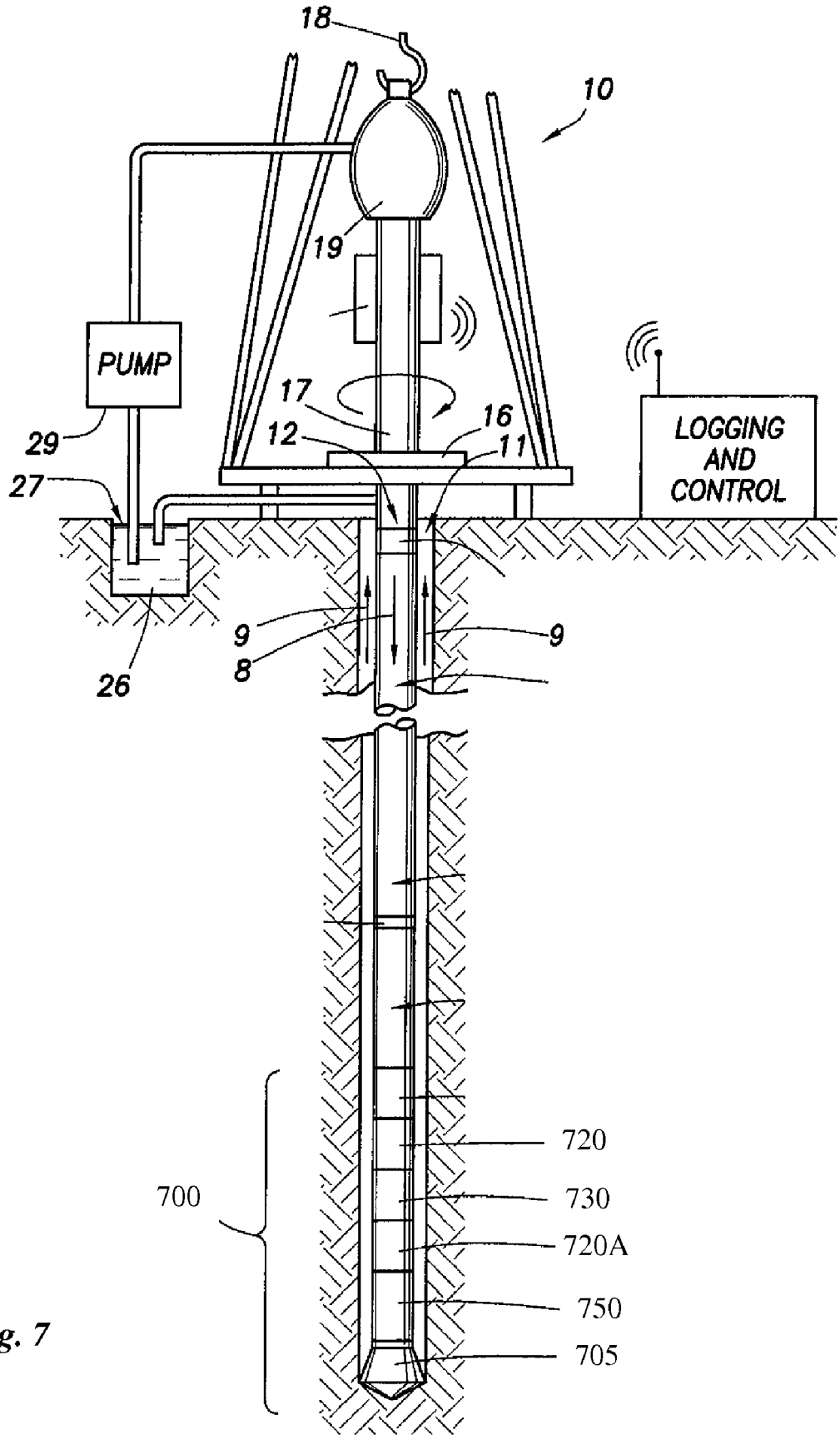
FIG. 7 is a schematic view of a system according to one or more aspects of the present disclosure.

Referring to FIG. 7, illustrated is a wellsite system 10 in which aspects of the present disclosure may be employed. The wellsite can be onshore or offshore. In this exemplary system, a borehole 11 is formed in subsurface formations by rotary drilling in a manner that is well known.

A drill string 12 is suspended within the borehole 11 and has a bottom hole assembly 700 which includes a drill bit 705 at its lower end. The surface system includes platform and derrick assembly 10 positioned over the borehole 11, the assembly 10 including a rotary table 16, kelly 17, hook 18, and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the illustrated example, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 705, and then circulates upwardly through the annulus region between the outside of the drill string and the wall of the borehole, as indicated by the directional arrows 9. In this well known manner, the drilling fluid lubricates the drill bit 705 and carries formation cuttings up to the surface as it is returned to the pit 27 for recirculation.

The bottom hole assembly 700 of the illustrated embodiment includes a logging-while-drilling (LWD) module 720, a measuring-while-drilling (MWD) module 730, a roto-steerable system and motor 750, and/or drill bit 705.

The LWD module 720 is housed in a special type of drill collar, as is known in the art, and can contain one or a plurality of known types of logging tools. It will also be understood that more than one LWD and/or MWD module can be employed, e.g. as represented at 720A. (References, throughout, to a module at the position of 720 can alternatively mean a module at the position of 720A as well.) The LWD module includes capabilities for measuring, processing, and storing information, as well as for communicating with the surface equipment. In the present example, the LWD module includes a pressure measuring device, which includes a probe assembly according to one or more aspects described above in reference to one or more of FIGS. 3-6F.

The MWD module 730 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

Figure 8:
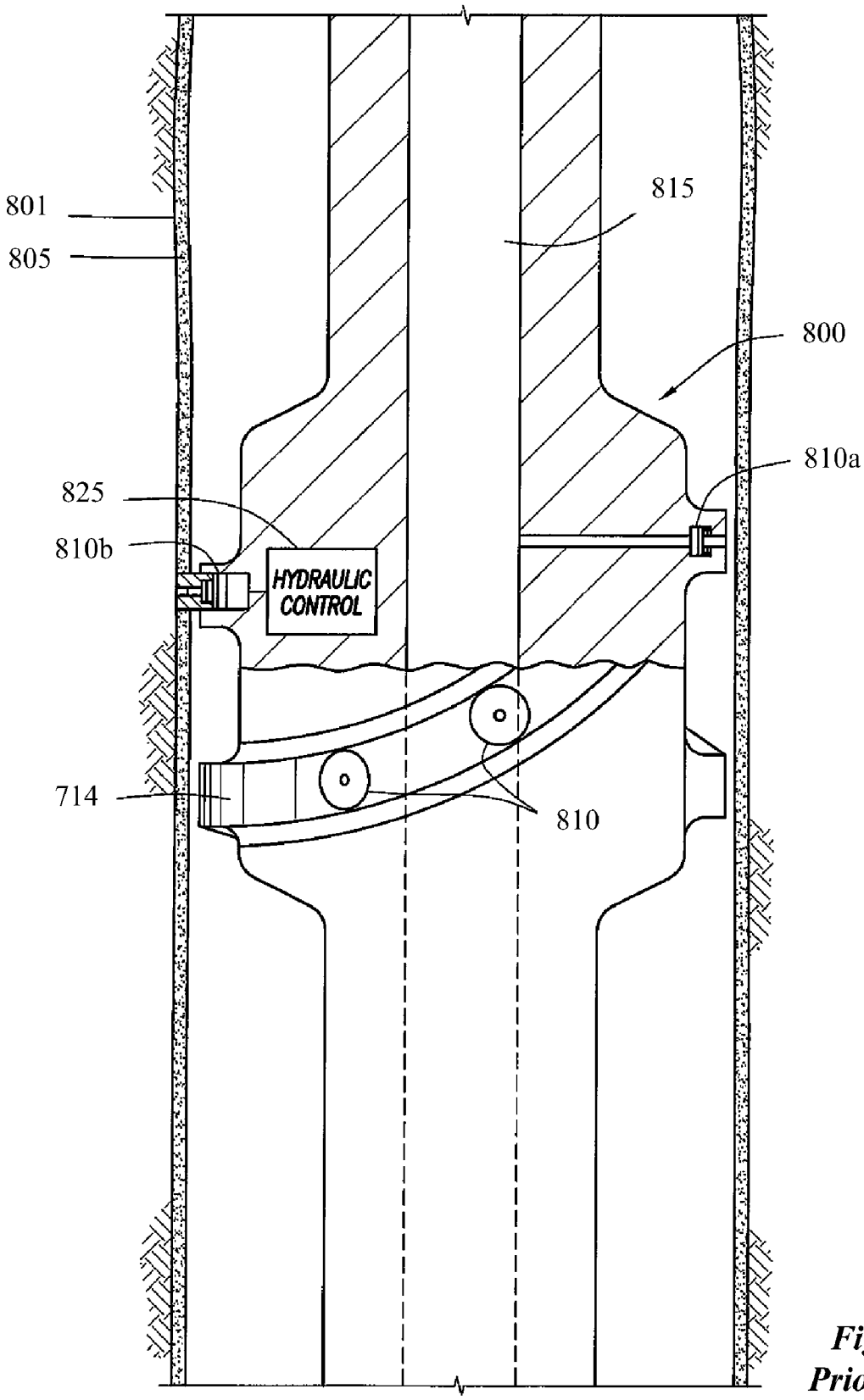
Fig. 8 Prior Art
FIG. 8 is a schematic view of an embodiment of a packer according to one or more aspects of the present disclosure.

FIG. 8 is a simplified diagram of a logging device, of a type disclosed in U.S. Pat. No. 6,986,282, incorporated herein by reference, for determining downhole pressures including annular pressure, formation pressure, and pore pressure, during a drilling operation, it being understood that other types of pressure measuring LWD tools can also be utilized as the LWD tool 720 or part of an LWD tool suite 720A. The device is formed in a modified stabilizer collar 800 which has a passage 815 extending therethrough for drilling fluid. The flow of fluid through the tool creates an internal pressure PI. The exterior of the drill collar is exposed to the annular pressure PA of the surrounding wellbore. The differential pressure δP between the internal pressure PI and the annular pressure PA is used to activate the pressure assemblies 810. Two representative pressure measuring assemblies are shown at 810*a* and 810*b*, respectively mounted on stabilizer blades. Pressure assembly 810*a* is used to monitor annular pressure in the borehole and/or pressures of the surrounding formation when positioned in engagement with the wellbore wall, and may be substantially similar to a probe assembly described above in reference to one or more of FIGS. 3-6F. In FIG. 8, pressure assembly 810*a* is in non-engagement with the borehole wall 801 and, therefore, may measure annular pressure, if desired. When moved into engagement with the borehole wall 801, the pressure assembly 810*a* may be used to measure pore pressure of the surrounding formation. As also seen in FIG. 8, pressure assembly 810*b* is extendable from the stabilizer blade 814, using hydraulic control 825, for sealing engagement with a mudcake 805 and/or the wall 801 of the borehole for taking measurements of the surrounding formation. The pressure assembly 810*b* may also or alternatively be substantially similar to a probe assembly described above in reference to one or more of FIGS. 3-6F. Circuitry (not shown in this view) couples pressure-representative signals to a processor/controller, an output of which is coupleable to telemetry circuitry.

Figure 9:
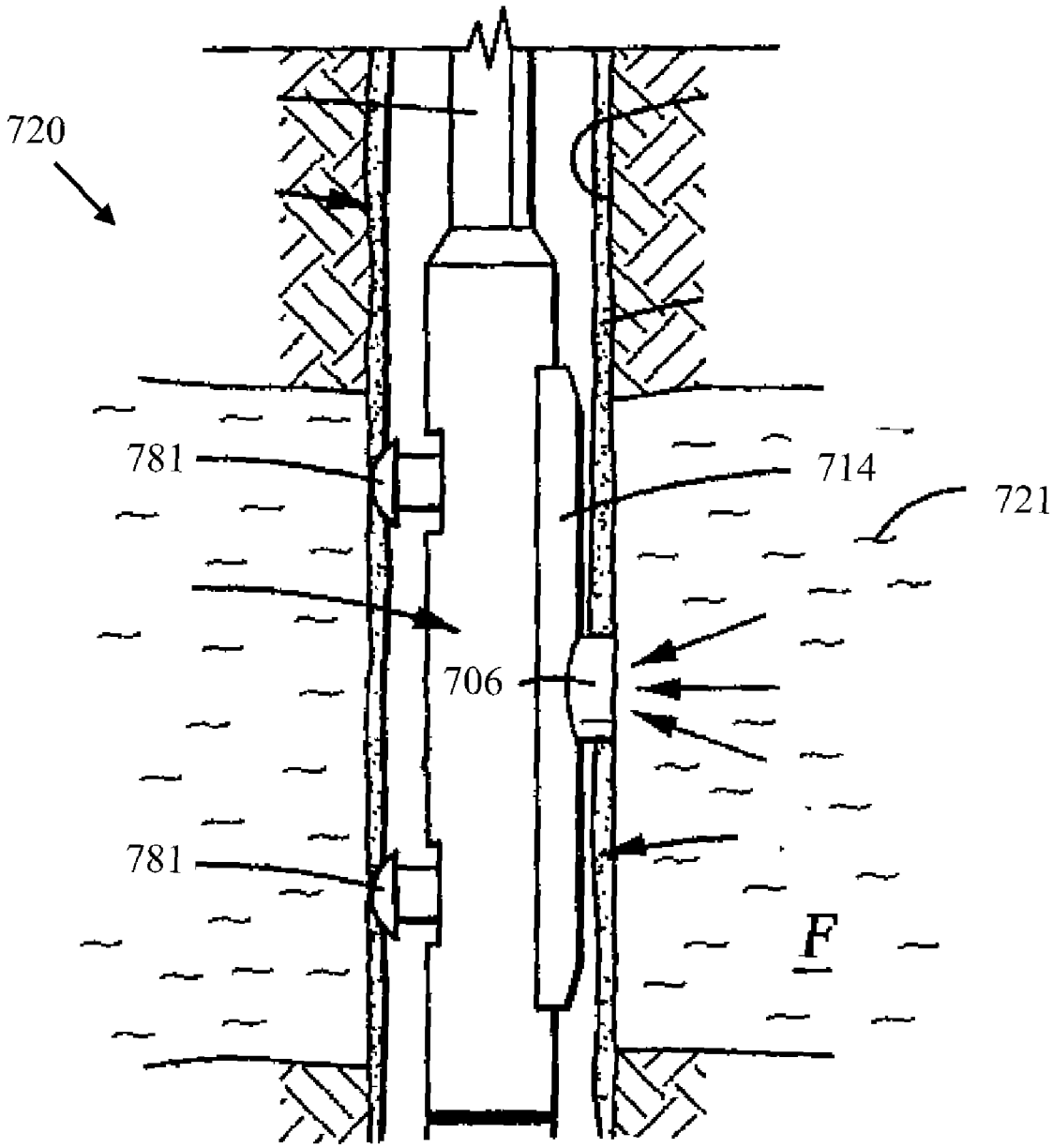
Fig. 9 Prior Art
FIG. 9 is a schematic view of an embodiment of a packer according to one or more aspects of the present disclosure.

FIG. 9 is a simplified diagram of a sampling-while-drilling logging device of a type described in U.S. Pat. No. 7,114,562, incorporated herein by reference, utilized as the LWD tool 720 or part of an LWD tool suite 720A. The LWD tool 720 is provided with a probe 706 for establishing fluid communication with the formation and drawing the fluid 721 into the tool, as indicated by the arrows. The probe may be positioned in a stabilizer blade 714 of the LWD tool and extended therefrom to engage the borehole wall. The stabilizer blade 714 comprises one or more blades that are in contact with the borehole wall. Fluid drawn into the downhole tool using the probe 706 may be measured to determine, for example, pretest and/or pressure parameters. Additionally, the LWD tool 720 may be provided with devices, such as sample chambers, for collecting fluid samples for retrieval at the surface. Backup pistons 781 may also be provided to assist in applying force to push the drilling tool and/or probe against the borehole wall.

Figure 10:
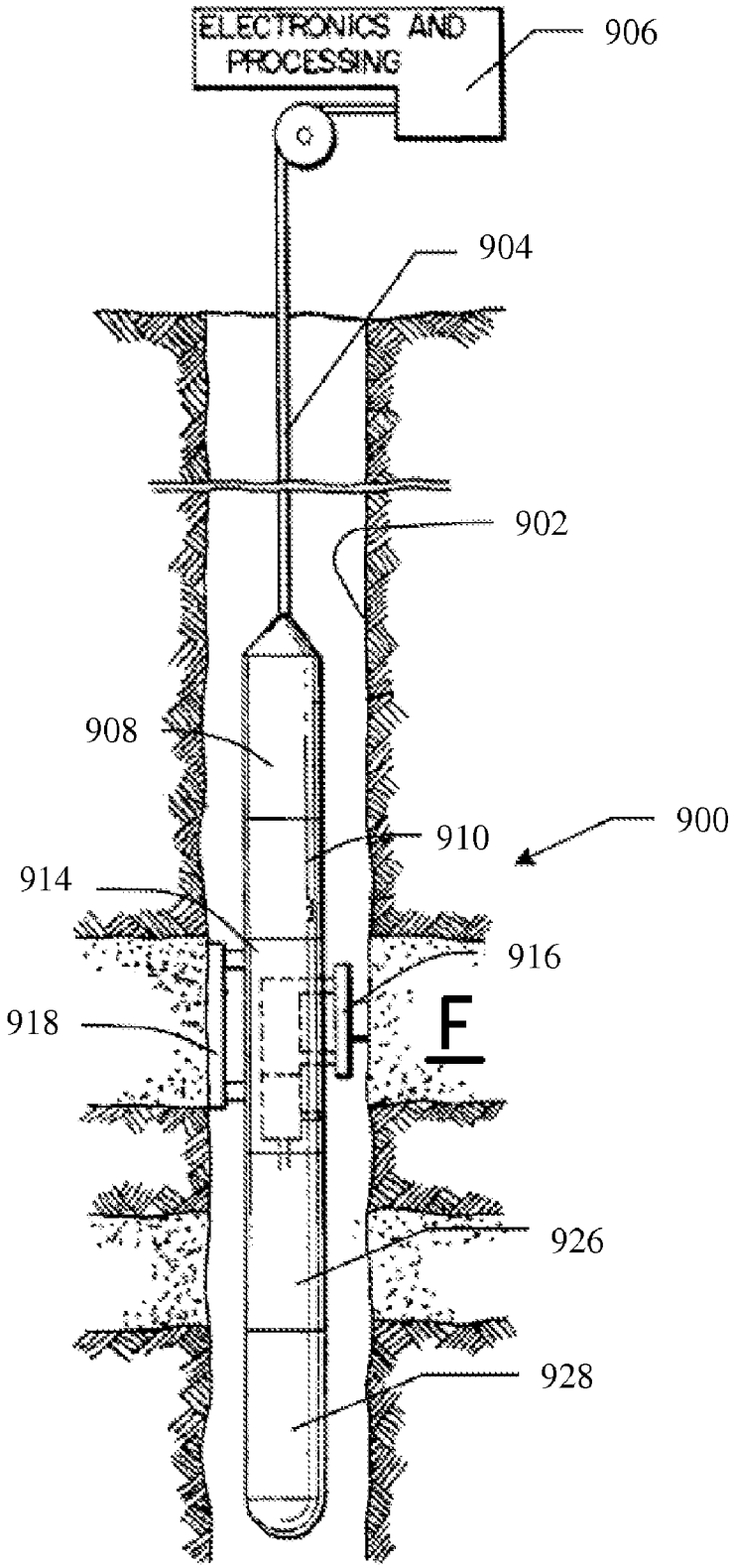
FIG. 10 is a schematic view of a system according to one or more aspects of the present disclosure.

Referring to FIG. 10, shown is an example wireline tool 900 that may be another environment in which aspects of the present disclosure may be implemented. The example wireline tool 900 is suspended in a wellbore 902 from the lower end of a multiconductor cable 904 that is spooled on a winch (not shown) at the Earth's surface. At the surface, the cable 904 is communicatively coupled to an electronics and processing system 906. The example wireline tool 900 includes an elongated body 908 that includes a formation tester 914 having a selectively extendable probe assembly 916 and a selectively extendable tool anchoring member 918 that are arranged on opposite sides of the elongated body 908. Additional components (e.g., 910) may also be included in the tool 900.

One or more aspects of the probe assembly 916 may be substantially similar to those described above in reference to the embodiments shown in FIGS. 3-6F. For example, the extendable probe assembly 916 is configured to selectively seal off or isolate selected portions of the wall of the wellbore 902 to fluidly couple to the adjacent formation F and/or to draw fluid samples from the formation F. Accordingly, the extendable probe assembly 916 may be provided with a probe having an embedded plate, as described above. The formation fluid may be expelled through a port (not shown) or it may be sent to one or more fluid collecting chambers 926 and 928. In the illustrated example, the electronics and processing system 906 and/or a downhole control system are configured to control the extendable probe assembly 916 and/or the drawing of a fluid sample from the formation F.

Figure 11:
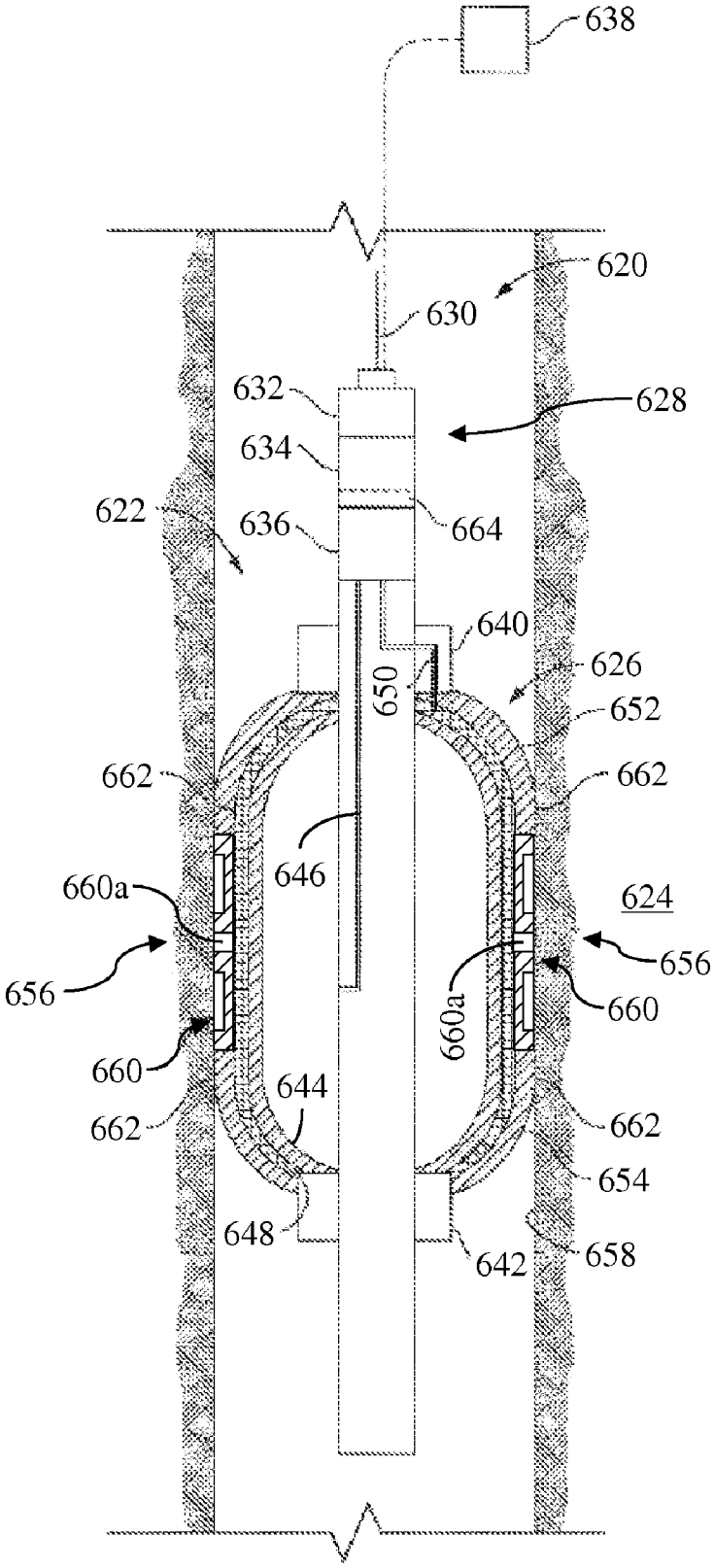
FIG. 11 is a schematic view of apparatus according to one or more aspects of the present disclosure.

Referring to FIG. 11, a single expandable packer 626 is illustrated in its expanded configuration. The expandable packer 626 shown in FIG. 11 is another environment in which one or more aspects of the present disclosure may also be implemented. Except as herein described, the packer 626 may be substantially similar to one or more embodiments described in U.S. Pat. Pub. 20070215348, the entirety of which is hereby incorporated by reference herein. FIG. 11 is a schematic view of an embodiment of a formation fluid sampling system 620 deployed in a wellbore 622 formed in a formation 624 from which a formation fluid sample is to be obtained. The formation fluid sampling system comprises a single inflatable packer 626 combined with, for example, a modular dynamics formation tester (MDT) tool 628. The MDT tool 628 and single inflatable packer 626 are deployed in wellbore 622 via a deployment system 630 that can comprise, for example, a cable, wireline, coiled tubing or other suitable deployment system.

The MDT tool 628 can be constructed in a variety of configurations depending on the specific sampling application. For example, the MDT tool 628 may comprise sample sections, multi-sample sections, pump system sections, electric sections, hydraulic sections, OFA modules, and other sections or modules in a variety of arrangements. MDT tools, in several configurations, are commercially available from Schlumberger Corporation. To facilitate explanation of the formation fluid sampling system 620, however, the MDT tool 628 is illustrated as having an electric section 632, a pumping system section 634, and a sample section 636 for storing a formation fluid sample obtained through packer 626. In some applications, sample section 636 may comprise a plurality of sample chambers individually activated by a surface control 638. For example, when pumping system 634 is operated to draw formation fluid samples from a desired location, electromechanically actuated throttle/seal valves (not shown) can be controlled by surface control 638 to direct each individual formation fluid sample into an appropriate corresponding sample chamber.

In the illustrated embodiment, MDT tool 628 is able to selectively expand single packer 626 when desired for the collection and analysis of a formation fluid sample. For example, MDT tool 628 and single packer 626 can be designed so that the MDT tool is able to selectively inflate the packer which causes it to expand against the surrounding wellbore wall. Once expanded, a formation fluid sample can be drawn in through the packer structure.

The illustrated single packer 626 comprises fixed mechanical ends 640 and 642 which define the longitudinal extremities of the packer. An inner sealing bladder 644 is positioned between fixed ends 640 and 642 and may be selectively inflated by pumping system 634 via a supply conduit 646, such as a hydraulic tube. Radially outward of inner sealing bladder 644, an expandable mechanical structure 648 is positioned to provide support for the overall packer structure. The expandable mechanical structure 648 also can be used to provide space for routing one or more conduits 650 (e.g., hydraulic hoses) through which fluid samples are obtained and directed to a collection location, such as sample section 636. The expandable mechanical structure 648 may comprise a variety of mechanical elements, including longitudinal slats, crisscrossing slats, mesh material or other materials or structures that accommodate repeated cycles of expansion and contraction.

The single expandable packer 626 further comprises at least two seal members 652 and 654 that are longitudinally separated to create a formation fluid sample intake region 656 through which formation fluid samples are drawn into packer 626 from the surrounding formation 624. The seal members 652 and 654 are designed to form a seal against a surrounding wall 658 that defines wellbore 622. The seal members are formed from appropriate sealing materials and may comprise elastomeric covers, e.g., rubber covers. In the embodiment illustrated, seal members 652 and 654 are positioned along the exterior of expandable mechanical structure 648 and may be located adjacent fixed ends 640 and 642, respectively. In fact, the longitudinally outlying ends of seal members 652 and 654 may be connected to fixed ends 640 and 642, respectively.

One or more embedded plates 660 may be positioned along an exterior of expandable mechanical structure 648 in the fluid sample intake region 656. Embedded plates 660 are substantially similar to one or more of the embedded plates described above, and are embedded within outer sealing members 652, 654 and/or mechanical structure 648. The fluid sample intake region 656 is generally enclosed other than embedded plates 660 and the one or more conduits 650. Thus, when single packer 626 is expanded and pumping system 634 is operated to create a decreased pressure or suction along conduit 650, formation fluid is drawn in through the one or more embedded plates 660 and along conduit 650 to the desired collection location. In the embodiment illustrated, the seal members 652 and 654 are located at opposed longitudinal ends of the one or more embedded plates 660.

In FIG. 11, a fluid (e.g., well fluid) has been directed by pumping system 634 into the interior of inner sealing bladder 644 via supply conduit 646. The delivery of fluid via supply conduit 646 causes inner sealing bladder 644 to expand radially which forces mechanical structure 648, embedded plates 660 and seal members 652, 654 to also expand radially outward. The radial expansion drives seal members 652, 654 against wellbore wall 658 to seal off fluid sample intake regions 656. The seal members 652, 654 create sealing contact regions 662 that enable the creation of a low-pressure area within conduit 650 and expandable mechanical structure 648 proximate fluid sample intake regions 656. It should be noted the pumping system 634 can be designed to pump fluid in a manner similar to that used in conventional dual packer configurations.

By creating a low-pressure area (i.e., suction), a formation fluid sample is drawn into sample intake regions 656 from the surrounding formation 624. The seal at contact regions 662 enables passage of the formation fluid sample through inlets 660*a* of embedded plates 660 and into the one or more conduits 650 for transport to sample section 636 without being contaminated by wellbore fluid. The suction can be created by operation of pumping system 634. For example, the pump used to inflate inner sealing bladder 644 can be reversed to draw the formation fluid sample into the packer structure. Alternatively, separate pumps can be used to expand the packer and to draw in the fluid sample, respectively. A valve system 664 also can be incorporated into the design and controlled via surface control 638 and/or electric section 632 to selectively control flow through supply conduit 646 and sample conduit 650. In one embodiment, the single pump can be used to inflate the inner sealing bladder 644 and to subsequently draw in the fluid sample while valve system 664 holds fluid within inner sealing bladder 644 to prevent premature contraction and release of packer 626.

Those skilled in the art will recognize that aspects of the present disclosure are applicable or readily adaptable to a plurality of different conveyance means. For example, the formation testing probe assembly disclosed herein may be a component of a logging-while-drilling (LWD) tool, a measurement-while-drilling (MWD) tool, and/or a wireline tool. Such conveyance means may also include wireline on TLC (drillpipe conveyance with wireline), wired-drillpipe conveyance, and/or coiled tubing conveyance. More generally, the formation testing probe assembly may be a component of a formation tester conveyed by any conveyance means known in the art.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A formation testing probe assembly, comprising:

an elongated packer having a surface configured to be urged by the probe assembly towards a wall of a wellbore extending through the formation; and a plate embedded in the elongated packer and including a central structural portion extending along a centerline of a substantial length of the plate, wherein the central structural portion is substantially thicker than remaining portions of the plate, and wherein the central structural portion extends in a direction substantially away from the packer surface.

2. The formation testing probe assembly of claim 1 wherein the central structural portion extends the entire length of the plate.

3. The formation testing probe assembly of claim 1 wherein the formation testing probe assembly is a component of a logging-while-drilling (LWD) tool.

4. The formation testing probe assembly of claim 1 wherein the formation testing probe assembly is a component of a wireline tool.

5. The formation testing probe assembly of claim 1 wherein the elongated packer is a portion of an expandable packer.

6. The formation testing probe assembly of claim 1 wherein the elongated packer substantially comprises an elastomeric material.

7. The formation testing probe assembly of claim 1 wherein the central structural portion has a substantially tapered profile.

8. The formation testing probe assembly of claim 7 wherein the central structural portion is tapered at an angle of about 150°.

9. A formation testing probe assembly, comprising:

an elongated packer having a surface configured to be urged by the probe assembly towards a wall of a wellbore extending through the formation; and a plate embedded in the elongated packer and including a central structural portion extending along a centerline of a substantial length of the plate, wherein the central structural portion is substantially thicker than remaining portions of the plate, and wherein the central structural portion extends in a direction substantially towards the packer surface.

10. The formation testing probe assembly of claim 9 wherein the central structural portion has a substantially rectangular profile.

11. The formation testing probe assembly of claim 9 wherein the central structural portion extends along approximately 25% of the entire length of the plate.

12. The formation testing probe assembly of claim 9 wherein the formation testing probe assembly is a component of a logging-while-drilling (LWD) tool.

13. The formation testing probe assembly of claim 9 wherein the formation testing probe assembly is a component of a wireline tool.

14. The formation testing probe assembly of claim 9 wherein the elongated packer is a portion of an expandable packer.

15. The formation testing probe assembly of claim 9 wherein the elongated packer substantially comprises an elastomeric material.

16. A formation testing probe assembly, comprising:

an elongated packer having a surface configured to be urged by the probe assembly towards a wall of a wellbore extending through the formation; and a plate embedded in the elongated packer and including a central structural portion extending along a centerline of a substantial length of the plate, wherein the central structural portion is substantially thicker than remaining portions of the plate, and wherein the central structural portion includes:

a first portion extending in a first direction substantially away from the packer surface; and a second portion extending in a second direction substantially towards the packer surface.

17. The formation testing probe assembly of claim 16 wherein the first portion of the central structural portion has a substantially tapered profile and the second portion of the central structural portion has a substantially rectangular profile.

18. The formation testing probe assembly of claim 16 wherein the first portion of the central structural portion extends the entire length of the plate and the second portion of the central structural portion does not extend the entire length of the plate.

19. The formation testing probe assembly of claim 16 wherein the formation testing probe assembly is a component of a logging-while-drilling (LWD) tool.

20. The formation testing probe assembly of claim 16 wherein the formation testing probe assembly is a component of a wireline tool.

21. The formation testing probe assembly of claim 16 wherein the elongated packer is a portion of an expandable packer.

22. The formation testing probe assembly of claim 9 wherein the elongated packer substantially comprises an elastomeric material.

23. A formation testing probe assembly, comprising:

an elongated packer having a surface configured to be urged by the probe assembly towards a wall of a wellbore extending through the formation; and a plate embedded in the elongated packer and including a central structural portion extending along a centerline of a substantial length of the plate, wherein the central structural portion is substantially thicker than remaining portions of the plate, and wherein the embedded plate further comprises a raised rim proximate a perimeter of the plate, wherein the rim has an outer surface that is substantially flush with the packer surface.

24. The formation testing probe assembly of claim 23 wherein the formation testing probe assembly is a component of a logging-while-drilling (LWD) tool.

25. The formation testing probe assembly of claim 23 wherein the formation testing probe assembly is a component of a wireline tool.

26. The formation testing probe assembly of claim 23 wherein the elongated packer is a portion of an expandable packer.

27. The formation testing probe assembly of claim 23 wherein the elongated packer substantially comprises an elastomeric material.

28. A formation testing probe assembly, comprising:

an elongated packer having a surface configured to be urged by the probe assembly towards a wall of a wellbore extending through the formation;

a plate embedded in the elongated packer and including a central structural portion extending along a centerline of a substantial length of the plate, wherein the central structural portion is substantially thicker than remaining portions of the plate; and an extendable barrel configured to be translated within the formation testing probe assembly towards the embedded plate, wherein:

the embedded plate includes a first inlet extending through the central support structure, the elongated packer includes a second inlet;

the first and second inlets are substantially coaxial with the extendable barrel; and the first inlet has an inner diameter that is substantially less than an outer diameter of the extendable barrel.

29. The formation testing probe assembly of claim 28 wherein the formation testing probe assembly is a component of a logging-while-drilling (LWD) tool.

30. The formation testing probe assembly of claim 28 wherein the formation testing probe assembly is a component of a wireline tool.

31. The formation testing probe assembly of claim 28 wherein the elongated packer is a portion of an expandable packer.

32. The formation testing probe assembly of claim 28 wherein the elongated packer substantially comprises an elastomeric material.

33. A formation testing probe assembly, comprising:

an elongated packer having a surface configured to be urged by the probe assembly towards a wall of a wellbore extending through the formation; and a plate embedded in the elongated packer and including a central structural portion extending along a centerline of a substantial length of the plate, wherein the central structural portion is substantially thicker than remaining portions of the plate, wherein the elongated packer has a substantially cylindrical outer surface, and wherein the embedded plate includes a raised lip extending around a perimeter of the embedded plate, and wherein the raised lip terminates at a surface that is substantially flush with the substantially cylindrical outer surface of the elongated packer.

34. The formation testing probe assembly of claim 33 wherein the formation testing probe assembly is a component of a logging-while-drilling (LWD) tool.

35. The formation testing probe assembly of claim 33 wherein the formation testing probe assembly is a component of a wireline tool.

36. The formation testing probe assembly of claim 33 wherein the elongated packer is a portion of an expandable packer.

37. The formation testing probe assembly of claim 33 wherein the elongated packer substantially comprises an elastomeric material.

* * * * *